US005104371A

United States Patent [19]

Ajnefors

[11] Patent Number: 5,104,371

[45] Date of Patent: Apr. 14, 1992

[54] CLEANING OF A CENTRIFUGAL SEPARATOR

[75] Inventor: Fredrik Ajnefors, Stockholm, Sweden

[73] Assignee: Alfa-Laval Marine & Power Engineering AB, Sweden

[21] Appl. No.: 469,424

[22] PCT Filed: Oct. 13, 1988

[86] PCT. No.: PCT/SE88/00532

§ 371 Date: Apr. 3, 1990

§ 102(e) Date: Apr. 3, 1990

[87] PCT Pub. No.: WO89/03251

PCT Pub. Date: Apr. 20, 1989

[30] Foreign Application Priority Data

Oct. 15, 1987 [SE] Sweden ..... 8704025

[51] Int. Cl.[5] ..... B04B 15/06; B04B 1/08; B04B 11/08

[52] U.S. Cl. ..... 494/27; 494/42; 494/70

[58] Field of Search ..... 494/27, 28, 35, 37, 494/42, 64, 70, 40, 85; 134/23, 33, 101, 166 R, 169 R; 366/138

[56] References Cited

U.S. PATENT DOCUMENTS

| | | | |
|---|---|---|---|
| 2,628,021 | 2/1953 | Staaff | 494/35 |
| 2,760,889 | 8/1956 | Peltzer, Sr. | 494/35 X |
| 2,788,008 | 4/1957 | Wanzer | 134/155 X |
| 2,905,380 | 9/1959 | Matthews, II | 494/35 X |
| 3,073,516 | 1/1963 | Glasson | 494/35 X |
| 3,752,389 | 8/1973 | Nilsson | 494/35 X |
| 4,759,744 | 7/1988 | Krook | 474/35 |
| 4,820,256 | 4/1989 | Nordstrom | 494/27 X |

FOREIGN PATENT DOCUMENTS

| | | |
|---|---|---|
| 60-104255 | 6/1985 | Japan . |
| 66664 | 3/1925 | Sweden . |
| 778503 | 7/1957 | United Kingdom . |

*Primary Examiner*—Harvey C. Hornsby

*Attorney, Agent, or Firm*—Seidel, Gonda, Lavorgna & Monaco

[57] ABSTRACT

The internal cleaning of a centrifuge rotor is performed by a cleaning liquid is which pumped from a tank via an inlet channel to a central inlet chamber of the rotor during rotation thereof. A separation chamber is connected to the inlet chamber and, at different radial levels, to two outlet chambers via separate outlet passages. Cleaning liquid is discharged from the outlet chambers through a stationary discharge device having separate outlet channels. Part of the cleaning liquid discharged through the outlet channels is returned to the tank via a return conduit. The rest of the cleaning liquid is conducted directly to the inlet channel by means of an overpressure generated in the stationary discharge device. Thereby, it is possible to clean the rotor internally even very close to its rotational axis.

17 Claims, 1 Drawing Sheet

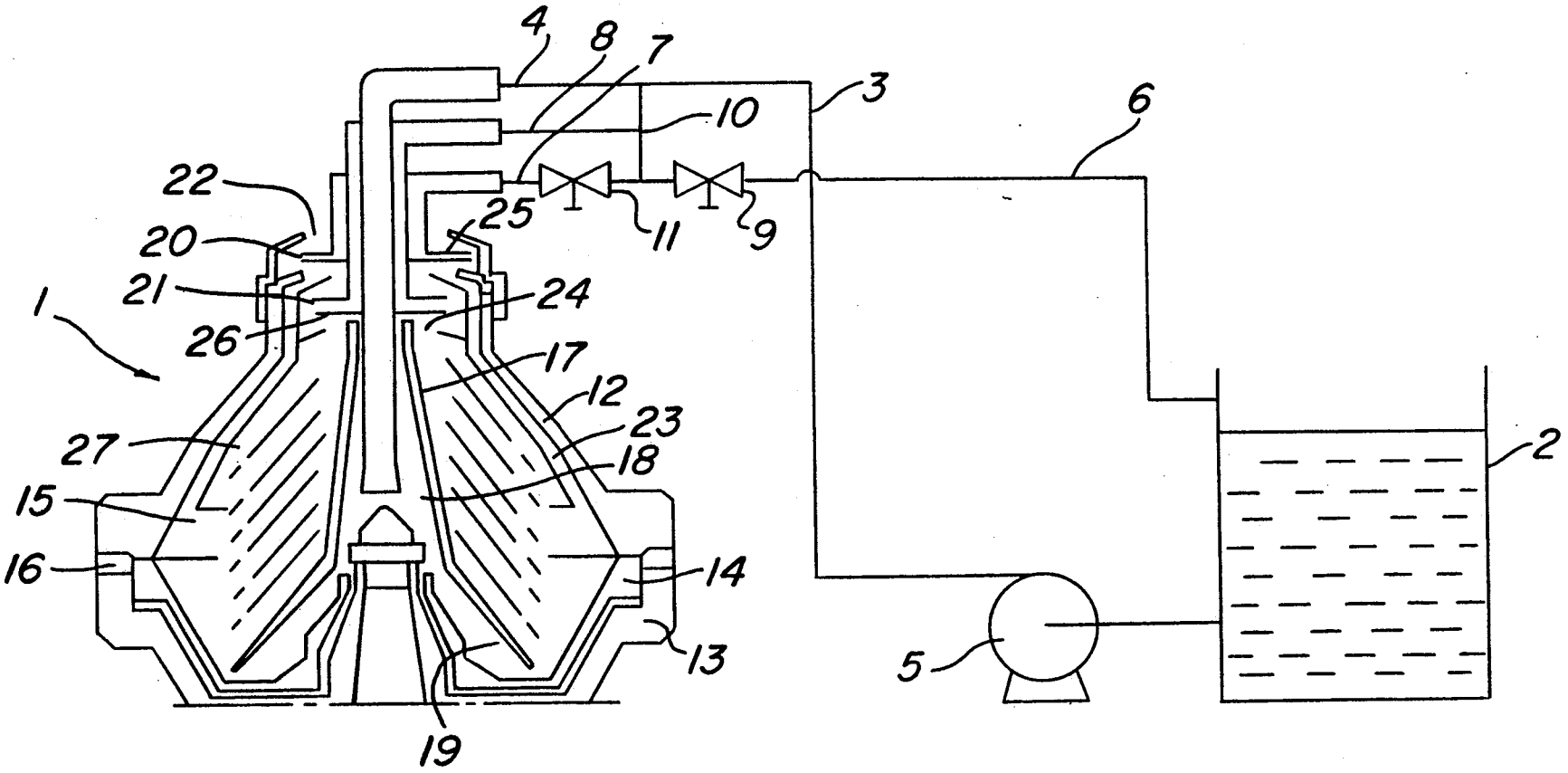
2
6
5
3
9
10
11
7
8
4
25
24
17
12
23
18
14
13
19
22
20
21
26
27
15
16
1

CLEANING OF A CENTRIFUGAL SEPARATOR

BACKGROUND OF THE INVENTION

The present invention concerns a method and an equipment for cleaning internally of a centrifugal rotor, which has a central inlet chamber, a separation chamber connected via an inlet passage to the inlet chamber, and two central outlet chambers connected via an outlet passage each to the separation chamber at separate radial levels in it. While the rotor is rotating, cleaning liquid is supplied to the inlet chamber via an inlet channel in a stationary inlet device and is discharged from the two outlet chambers via outlet channels in a stationary outlet device.

A method for such an internal cleaning of a centrifugal rotor is described in JP U 60-104255. In this all cleaning liquid is supplied to the centrifugal rotor by means of a centrifugal pump arranged in an inlet conduit between a tank and the centrifugal rotor. Furthermore, all cleaning liquid, which is discharged via the outlet chambers of the centrifugal rotor is conducted back to the tank. However, it proves in practice difficult to obtain an acceptable cleaning result with the suggested method. Often one cannot get the radial innermost part of the centrifugal rotor clean enough. In many cases one therefore with equal time intervals has to disassemble the centrifugal rotor manually, clean it internally, including inserts present therein, and reassemble the same. This is a very time consuming operation. Especially this is the case in centrifugal rotors, in which a stack of conical discs is arranged in the separation chamber. If the separator is used for dewatering and cleaning of oils, this time consuming and also dirty operation often recurs. In some cases the cleaning has to take place every two hundred hours of operation.

SUMMARY OF THE INVENTION

The object of the present invention is to provide a better method and a better equipment for cleaning internally of a centrifugal rotor, so that it does not have to be disassembled and cleaned manually. According to the invention this is achieved by conducting only a part of the cleaning liquid, which is discharged out of a centrifugal rotor of the kind initially described to a tank with cleaning liquid, out of which cleaning liquid by means of a pump is pumped into the inlet channel of a centrifugal rotor, whereas the rest of the discharged cleaning liquid is conducted directly to the inlet channel by means of an overpressure generated in the outlet device by the rotation of the rotor. Hereby a high flow of cleaning liquid into the rotor via the inlet channel can be achieved by means of a relatively small pump at the same time as a volume of cleaning liquid as large as needed for an acceptable cleaning result freely can be adapted to the case at hand.

The cleaning liquid present inside the rotor forms a liquid body rotating with the rotor, which in the outlet chambers extends radially inwards inside the greatest radius of the stationary outlet device arranged therein at which the outlet channels open. Upon stabilized flow conditions the radially inwardly directed free liquid surfaces of the liquid body in the different chambers of the rotor take a position at such radial levels that the total liquid flow out through the outlet channels becomes as large as the liquid flow in through the inlet channel. The higher flow that is achieved in the inlet channel the closer the free liquid surfaces to the rotational axis of the rotor thus will be. Since a large part of the cleaning liquid flowing out of the outlet channels according to the invention can be conducted directly to the inlet channel by means of the overpressure generated in the outlet device by the rotation of the rotor, a very high flow of cleaning liquid can be achieved in the inlet channel without the need of a separate pump having a correspondingly high capacity. Thus, during stabilized conditions it is possible thanks to the invention to have the free liquid surfaces of the rotating liquid body inside the rotor to take a position at radial levels, which are located at considerably smaller radius than the radius which hitherto has been practical possible.

In a preferred embodiment of the invention the liquid body is built up further radially inwards by restricting the flow from at least one of the outlet channels to the tank, a bigger amount of cleaning liquid being pumped during a certain time period from the tank to the inlet channel than from the outlet channels to the tank until the flows in and out of the rotor balance each other again.

In another preferred embodiment of the invention the liquid body also is built up radially inwards by restricting an initial flow out of the outlet chamber, which is connected to the radial outer part of the separation chamber, so that a flow of cleaning liquid is achieved from the separation chamber also to the second outlet chamber.

BRIEF DESCRIPTION OF THE DRAWING

In the following the invention is described in more detail with reference to the accompanying drawing, on which an equipment according to the invention is shown schematically. The equipment is connected to a centrifugal rotor of the type in question. On the drawing there is shown schematically an axial section through the separator.

The equipment has a tank 2 with cleaning liquid, a supply conduit 3, which connects the tank 2 to the inlet channel 4 of the centrifugal rotor 1, a pump 5 arranged in the supply conduit 3, a return conduit 6, which connects the two outlet channels 7 and 8 of the separator with the tank 2. In the return conduit 6 a flow restriction 9 is arranged. The two outlet channels 7 and 8 are also connected directly to the inlet channel 4 via a communication conduit 10. In one of the outlet channels 7 there is arranged a flow restriction 11 before the connection of it to the return conduit 6 and before the connection of it to the communication conduit 10 seen in the flow direction.

The centrifugal rotor shown in the example has an upper part 12 and a lower part 13, which parts are joined together by a not shown locking ring. Inside the rotor an axially movable valve slide 14 is arranged, which together with the upper part 12 delimits the separation chamber 15. The movable valve slide 14 is arranged to open and close an annular passage between the separation chamber 15 and peripheral openings 16.

Centrally inside the rotor a distributor 17 is arranged, which delimits a central inlet chamber 18. The inlet chamber 18 communicates with the separation chamber 15 via an inlet passage 19.

The upper part 12 forms in its upper end two central outlet chambers 20 and 21, the one 20 of which communicates with the surroundings of the rotor via a central annular gap 22. The two outlet chambers 20 and 21 communicate with the separation chamber 15 via an outlet passage each 23 and 24, respectively. One of the outlet passages 23 connects one of the outlet chambers 20 to the radially outer part of the separation chamber 15, whereas the other outlet passage 24 connects the other outlet chamber 21 to the central part of the separation chamber 15. Centrally there is arranged a stationary discharge device having two outlet devices 25 and 26, one in each outlet chamber 20 and 21. The outlet device 25 and 26 has internal channels, through which liquid present in the discharge chamber is discharged under pressure towards outlet channels 7 and 8 arranged centrally in the discharge device. Centrally in the rotor there is also arranged a stationary inlet channel 4 which opens into the central inlet chamber 18.

Furthermore, the centrifugal rotor shown as an example is provided with a stack of conical discs 27 arranged in the separation chamber 15. In the shown example one of the outlet chambers 20 communicates via the gap 22 with the surroundings of the rotor at a radius which is larger than the radius at which the other outlet chamber 21 is connected to the separation chamber 15. This design is often used when separating liquid components in a mixture (e.g. when cleaning of oils containing water) in order to prevent to a certainty a specifically heavier component (water) from following the specifically lighter component (oil).

DETAILED DESCRIPTION OF THE PREFERRED EMBODIMENT

The cleaning of the internal of a centrifugal rotor of this kind is taking place according to the invention in the following manner.

The centrifugal rotor 1 connected to the cleaning equipment is brought into rotation whereupon the separation chamber 15 is closed by bringing the valve slide 14 in conventional manner in a position closing the passage towards the openings 16. When the separation chamber 15 is closed the pump is started whereby cleaning liquid is pumped from the filled tank 2 to the separation chamber 15 via the inlet channel 4 and the inlet chamber 18. The separation chamber 15 and the other chambers inside the rotor is filled up gradually with cleaning liquid. The cleaning liquid inside the rotor then forms a liquid body rotating with the rotor having a radial inwards directed free liquid surface located on a radially gradually decreasing level. Little by little cleaning liquid flows through the outlet passage 23 which opens in the radial outer part of the separation chamber 15 to one of the outlet chambers 20, which thus is filled up and the stationary outlet device arranged therein starts under pressure to discharge cleaning liquid out of it through the outlet channel 7 belonging to it, from which a part is conducted back to the tank 2 via the return conduit 6 whereas the rest of the cleaning liquid discharged via the outlet channels is conducted from this outlet channel 7 directly to the inlet channel 4 via the communication conduit 10 by means of the overpressure generated in the outlet device by the rotation of the rotor. In a preferred modification of the method an initial flow, which flows back to the tank 2 via the return conduit 6, is diminished by means of a restriction 9, which is arranged in the return conduit 6 whereby the flow into the rotor via the inlet channel 4 increases. The volume of cleaning liquid inside the rotor increases until balance is at hand between the flow, which flows out of the rotor and the flow, which flows into the rotor via the inlet channel. The flow into the rotor hereby consists of the flow through the communication conduit 10 and the flow through the supply conduit 3. The high flow through the rotor, which mainly flows through the outer passage 23, which opens into the radially outer parts of the separation chamber 15, results in a pressure drop in this outlet passage 23. Hereby the free liquid surface in the separation chamber 15 upon equilibrium will take a position at a radius, which is correspondingly smaller than the radius of the free liquid surface in the outlet chamber 20 connected to this outlet passage 23. This means that the free liquid surface in the separation chamber 15 at a certain flow through the outlet passage 23 is located radially inside the radius, at which the other outlet passage 24 opens into the central part of the separation chamber 15. Thereby a part of the cleaning liquid will flow into the other outlet chamber 21 via the other outlet passage 24 and fill up the same. From this other outlet chamber 21 cleaning liquid is discharged under pressure by means of the stationary outlet device centrally arranged therein via the outlet channel 8 connected thereto, from which a part is flowing through the return conduits back to the tank whereas the rest of the cleaning liquid discharged through the outlet channels is conducted from this outlet channel 8 directly to the inlet channel 4 via the communication conduit 10 by means of the prevailing pressure in this outlet channel 8.

As soon as cleaning liquid flows through this outlet channel, which can be indicated by means of a flow meter, a pressure meter or a sight glass, one knows that cleaning liquid flows inside the rotor and cleans the rotor internally at least radially into the radial level at which cleaning liquid leaves the separation chamber 15 through said other outlet passage 24. Since the stack of conical discs completely is located radially outside this level it hereby will be cleaned all the way into its inner radius.

According to another modification of the invention the flow out through said one outlet channel 7 initially is diminished by means of a restriction 11 arranged in it. Hereby it is guaranteed that the rotating liquid body in the separation chamber 15 extends radially inwards inside the stack of conical discs 27 arranged therein to the connection of the other outlet passage 24 to the separation chamber 15 and that cleaning liquid present in the radially innermost part of the liquid body has a flow rate sufficient for the cleaning result.

After this the cleaning procedure goes on by circulating the cleaning liquid through the centrifugal rotor and the connected equipment during a necessary time. It is then seen that the cleaning liquid is kept at a suitable temperature for the cleaning result. The heating is taking place by the friction it is exposed for. Possibly, a cooling of the cleaning liquid is necessary, which preferably is done by air cooling at the inlet to the tank. After a predetermined time the centrifugal rotor and the equipment are emptied by bringing the valve slide in a position opening the passage towards the openings 16. Hereby the cleaning liquid and in the rotor remaining impurities are exposed to a chock operation, which furthermore improves the cleaning result. When the centrifugal rotor and the equipment have been emptied of cleaning liquid, clean water is supplied to the tank 2 and is brought into circulation through the centrifugal rotor and the equipment in the same manner as described above for the cleaning liquid whereby the centrifugal rotor is rinsed. The cleaning procedure is ended by emptying the centrifugal rotor and the equipment once again in the same manner as above.

In the example the two outlet channels 7 and 8 are connected to the tank 2 and the inlet channel 4. Of course it is quite possible to connect the outlt channels in many other ways within the scope of the present invention. For instance, might only one of the outlet chambers 20 and 21 be connected to the tank 2. Preferably is in such a case only the outlet chamber 21, which is connected to the separation chamber 15 at the innermost located radial level connected to the tank 2.

I claim:

1. A method for cleaning a centrifugal rotor, which has a central inlet chamber, a separation chamber connected via an inlet passage to the inlet chamber, and two central discharge chambers each connected via an outlet passage to the separation chamber at separate radial levels, comprising the steps of: supplying a cleaning liquid from a tank containing cleaning liquid during rotation of the rotor to the inlet chamber, directing the cleaning liquid via an inlet channel in a stationary inlet device to dislodge and/or remove unwanted material, and discharging the cleaning liquid from the two discharge chambers via outlet channels in a stationary outlet device arranged in the outlet chamber thereby carrying away the unwanted material, conducting a part of the cleaning liquid, which is discharged via the outlet channels to the tank containing cleaning liquid, pumping cleaning liquid from the tank into said inlet channel, and conducting the rest of the cleaning liquid discharged via the outlet channels directly to the inlet channel by means of an over-pressure generated in the outlet device by the rotation of the rotor.

2. A method according to claim 1, further comprising the steps of: after the flow has been established from at least one of the outlet channels directly to the inlet channel, throttling the flow from the outlet channels to the tank and pumping a greater amount of cleaning liquid during a certain time period from the tank to the inlet channel than the amount of flow from the outlet channels to the tank, thus filling the chambers inside the rotor with cleaning liquid during the cleaning procedure.

3. A method according to claim 1, further comprising the step of throttling the initial flow out of the discharge chamber, which is connected to the radial outer part of the separation chamber, so that a flow of cleaning liquid also is obtained from the separation chamber to the other discharge chamber.

4. A method according to claim 1, further comprising the step of supplying cleaning liquid to the separation chamber via the inlet chamber with a high flow sufficient that the outlet passage, which is connected to the radial outer part of the separation chamber, will form a flow restriction for the flow of cleaning liquid to the corresponding discharge chamber.

5. A method according to claim 1, further comprising the step of combining cleaning liquid which is discharged via one outlet channel together with the part of the cleaning liquid discharged via the other outlet channel.

6. Equipment for cleaning the interior of a centrifugal rotor, comprising: a rotor, the rotor having a central inlet chamber, a separation chamber, an inlet passage, the separation chamber connected via the inlet passage to the inlet chamber, two central discharge chambers, two outlet passages, each discharge chamber connected via one of the outlet passages to the separation chamber, the connection by the two outlet passages being made at separate radial levels, two stationary outlet devices, one said outlet device partially extending into each discharge chamber, two outlet channels, each said outlet channel connected to a corresponding stationary outlet device, a tank for retaining cleaning liquid, a supply conduit, a stationary inlet device, an inlet channel within the stationary inlet device, the supply conduit connecting the tank to the inlet chamber via the inlet channel, a pump arranged to pump cleaning liquid from the tank to the inlet chamber via the inlet channel, a return conduit connecting at least one of the outlet channels to the tank, and a connection conduit connecting at least one of the outlet channels pressure transmittingly to the inlet channel.

7. Equipment according to claim 6, further comprising means for connecting the outlet channels to each other at their outlets.

8. Equipment according to claim 6, wherein the return conduit is provided with flow restricting means.

9. Equipment according to claim 6, wherein the outlet channel, which via one of the outlet passages in the rotor communicates with the radial outer part of the separation chamber, is connected to the inlet channel, and a flow restricting means is provided in this outlet channel upstream of the connection conduit.

10. Equipment according to claim 8, wherein the outlet channel, which via one of the outlet passages in the rotor communicates with the radial inner part of the separation chamber, is connected to said connection conduit, and that the connection conduit is connected to the return conduit upstream of the flow restricting means in the latter.

11. A method according to claim 2, further comprising the step of throttling the initial flow out of the discharge chamber, which is connected to the radial outer part of the separation chamber, so that a flow of cleaning liquid also is obtained from the separation chamber to the other discharge chamber.

12. A method according to claim 2, further comprising the step of supplying cleaning liquid to the separation chamber via the inlet chamber with a high flow sufficient that the outlet passage, which is connected to the radial outer part of the separation chamber, will form a flow restriction for the flow of cleaning liquid to the corresponding discharge chamber.

13. A method according to claim 3, further comprising the step of supplying cleaning liquid to the separation chamber via the inlet chamber with a high flow sufficient that the outlet passage, which is connected to the radial outer part of the separation chamber, will form a flow restriction for the flow of cleaning liquid to the corresponding discharge chamber.

14. Equipment according to claim 7, wherein the return conduit is provided with flow restricting means.

15. Equipment according to claim 7, wherein the outlet channel, which via one of the outlet passages in the rotor communicates with the radial outer part of the separation chamber, is connected to the inlet channel, and a flow restricting means is provided in this outlet channel upstream of the connection conduit.

16. Equipment according to claim 8, wherein the outlet channel, which via one of the outlet passages in the rotor communicates with the radial outer part of the separation chamber, is connected to the inlet channel, and a flow restricting means is provided in this outlet channel upstream of the connection conduit.

17. Equipment according to claim 9, wherein the outlet channel, which via one of the outlet passages in the rotor communcates with the radial inner part of the separation chamber, is connected to said connection conduit, and that the connection conduit is connected to the return conduit upstream of the flow restricting means in the latter.

* * * * *